US007520141B2

(12) United States Patent
Nuiding

(10) Patent No.: US 7,520,141 B2
(45) Date of Patent: Apr. 21, 2009

(54) REFRIGERATING MACHINE WITH A PRESSURE-SIDE REFRIGERANT HEADER

(75) Inventor: Wolfgang Nuiding, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 643 days.

(21) Appl. No.: 10/873,499

(22) Filed: Jun. 21, 2004

(65) Prior Publication Data

US 2005/0005632 A1 Jan. 13, 2005

Related U.S. Application Data

(63) Continuation of application No. PCT/EP02/13816, filed on Dec. 5, 2002.

(30) Foreign Application Priority Data

Dec. 19, 2001 (DE) ..... 101 62 500

(51) Int. Cl.
*F25B 43/00* (2006.01)
*F25B 1/00* (2006.01)

(52) U.S. Cl. ..... 62/474; 62/498

(58) Field of Classification Search ..... 62/474, 62/475, 507, 525, 85, 468, 498
See application file for complete search history.

(56) References Cited

U.S. PATENT DOCUMENTS 5,440,898 A * 8/1995 Starr ..... 62/474

FOREIGN PATENT DOCUMENTS

| | | | |
|---|---|---|---|
| EP | 0 703 421 | A2 | 3/1996 |
| EP | 1 147 930 | A1 | 10/2001 |
| JP | 08061811 | A | 3/1996 |
| JP | 2000213831 | A | 8/2000 |
| JP | 2001141341 | A | 5/2001 |
| WO | WO 00/17588 | | 3/2000 |

* cited by examiner

*Primary Examiner*—William E Tapolcai
(74) *Attorney, Agent, or Firm*—Russell W. Warnock; James E. Howard

(57) ABSTRACT

A refrigerating machine for a refrigerating appliance, particularly a household refrigerating appliance, includes a compressor, a condenser, a multi-way valve for selectively directing the refrigerant flow through a refrigerant collector from an inlet to a first outlet of the same or through a bypass line while bypassing the first outlet and includes at least one first evaporator. A collecting sieve for intercepting contaminants within the refrigerant flow is placed between the inlet and the first outlet of the refrigerant collector.

3 Claims, 1 Drawing Sheet

REFRIGERATING MACHINE WITH A PRESSURE-SIDE REFRIGERANT HEADER

CROSS-REFERENCE TO RELATED APPLICATION

This application is a continuation, under 35 U.S.C. § 120, of copending international application No. PCT/EP02/13816, filed Dec. 5, 2002, which designated the United States; this application also claims the priority, under 35 U.S.C. § 119, of German patent application No. 101 62 500.6, filed Dec. 19, 2001; the prior applications are herewith incorporated by reference in their entirety.

BACKGROUND OF THE INVENTION

Field of the Invention

The present invention relates to a refrigerating machine, in which a refrigerant header is disposed on a high-pressure side of the refrigerant circuit and to a refrigerator, in particular, household refrigerator, which is equipped with such a refrigerating machine.

Such a refrigerating machine with a compressor, a condenser, a directional valve for the selective guidance of the refrigerant stream through a refrigerant header from an inlet to a first outlet of the latter or through a secondary line, bypassing the first outlet, and at least one first evaporator are disclosed in European Patent EP 0 703 421 B1. In this known refrigerating machine, a 3/2-way solenoid valve is disposed between the condenser and a series connection of evaporators and makes it possible to supply refrigerant coming from the condenser selectively directly or through a refrigerant header to the evaporators. The refrigerant, which, coming from the condenser, flows through the solenoid valve, is partly gaseous and partly liquid. When it flows through the refrigerant header, the ratio of gaseous to liquid refrigerant corresponds in the latter to the ratio at the outlet of the condenser, and the entire refrigerant present in the refrigerating machine circulates through the evaporators. When the refrigerant is supplied directly from the directional valve to the evaporators, bypassing the refrigerant header, a lower temperature is established in the refrigerant header and leads to the condensation of the refrigerant in the latter. This is extracted from the refrigerant circuit that, thus, operates in an underfilling state. Whereas, when the flow passes through the refrigerant header, the liquid refrigerant is sufficient to cool the series of evaporators as far as the end, in this underfilled state an evaporator at the end of the series remains uncooled. Thus, depending on the state of the directional valve, there can be a changeover between the cooling of all the compartments in the refrigerator and the selective cooling of individual compartments.

A drier cartridge disposed between the condenser and the inlet of the solenoid valve serves for absorbing from the liquid refrigerant a residual water content that occurs during the filling of the refrigerant circuit. Such a drier cartridge conventionally also contains a fine sieve that is provided for keeping in place a drier substance used in the cartridge, but which also serves for intercepting from the refrigerant stream dirt particles or flux residues that originate substantially from the assembly of the refrigerant circuit and that could otherwise reach the solenoid valve and disturb its functioning capacity.

Although the drier cartridge, therefore, has an important function substantially only in an early phase of the service life of the refrigerating machine, its flow resistance impedes the circulation of the refrigerant during the entire service life of the machine.

SUMMARY OF THE INVENTION

It is accordingly an object of the invention to provide a refrigerating machine with a pressure-side refrigerant header that overcomes the hereinafore-mentioned disadvantages of the heretofore-known devices of this general type and that improves upon the prior art to achieve effective protection of the solenoid valve against impurities, with as little contribution as possible of the drier cartridge to the overall flow resistance of the refrigerant circuit.

With the foregoing and other objects in view, there is provided, in accordance with the invention, a refrigerating machine, including a compressor for compressing a refrigerant, a condenser, a refrigerant header having an inlet, a first outlet, and a secondary line bypassing the first outlet, a collecting sieve disposed between the inlet and the first outlet of the refrigerant header for intercepting impurities of a stream of the refrigerant, a directional valve selectively guiding the refrigerant stream through one of the refrigerant header from the inlet to the first outlet and the secondary line; and at least one first evaporator.

With the objects of the invention in view, there is also provided a refrigerating machine, including a compressor for compressing a refrigerant, a condenser fluidically connected to the compressor, a refrigerant header fluidically connected to the condenser, the header having an inlet, a first outlet, and a secondary line bypassing the first outlet, a collecting sieve disposed between the inlet and the first outlet of the refrigerant header for intercepting impurities of a stream of the refrigerant, a directional valve fluidically connected to the first outlet and to the secondary line and selectively guiding the refrigerant stream through one of the refrigerant header from the inlet to the first outlet, and the secondary line, and at least one first evaporator fluidically connected to the directional valve and to the compressor.

With the objects of the invention in view, there is also provided a refrigerator having the refrigerating machine according to the invention.

The collecting sieve provided according to the invention in the refrigerant header may have different affects, depending on the construction of the overall refrigerant circuit of the refrigerating machine. On one hand, when it has the necessary fineness, the collecting sieve in the refrigerant header makes it possible to dispense with a fine sieve for the interception of impurities in the drier and, thereby, to reduce the pressure drop in the refrigerant circuit; to intercept residual moisture and impurities that originate from the assembly of the refrigerant circuit, it is sufficient, in an initial operating phase, to lead the refrigerant through the refrigerant header until the impurities are intercepted completely in the latter and the moisture is intercepted completely in the drier.

In accordance with another feature of the invention, preferably, the secondary line emanates from a second outlet disposed in the upper region of the refrigerant header, and the first outlet in the refrigerant header is disposed in a lower region of the latter. This makes it possible to separate, purely according to their weight, impurities in the refrigerant header that are to be sieved out, without the refrigerant having to pass across the collecting sieve: impurities that are denser than the refrigerant automatically sink in the refrigerant header and settle on the collecting sieve of the latter, even when the fed-in refrigerant leaves the header again through its second outlet, without passing across the collecting sieve.

In accordance with a further feature of the invention, the drier precedes the refrigerant header in the refrigerant flow direction and the collecting sieve has a mesh size finer than the fine sieve.

Preferably, nevertheless, a fine sieve is also provided on the drier, and the drier precedes the directional valve. As such, impurities having different particle sizes can be intercepted at two different sieves with an adapted mesh width, thus, reducing the pressure drop, as compared with the use of an individual sieve where the risk of clogging with particles of different size cannot be ruled out.

In accordance with an added feature of the invention, the refrigerant header has a second outlet from which the secondary line extends, a lower region, and an upper region, the second outlet is disposed in the upper region of the refrigerant header, and the first outlet is disposed in the lower region of the refrigerant header.

In accordance with an additional feature of the invention, refrigerant that flows from the inlet to the second outlet of the refrigerant header does not pass across the collecting sieve.

In accordance with yet another feature of the invention, when the directional valve guides the refrigerant stream through the secondary line, refrigerant flowing from the inlet to the second outlet of the refrigerant header does not pass across the collecting sieve.

In accordance with yet a further feature of the invention, when the directional valve guides the refrigerant stream through the secondary line, refrigerant flows only from the inlet to the second outlet.

In accordance with a concomitant feature of the invention, there is provided at least one second evaporator following the first evaporator in a flow direction of the refrigerant; and the refrigerant header having a capacity dimensioned so that, in a filled state of the refrigerant header, a refrigerant quantity circulating through the secondary line is already evaporated when the refrigerant quantity reaches the second evaporator.

Other features that are considered as characteristic for the invention are set forth in the appended claims.

Although the invention is illustrated and described herein as embodied in a refrigerating machine with a pressure-side refrigerant header, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
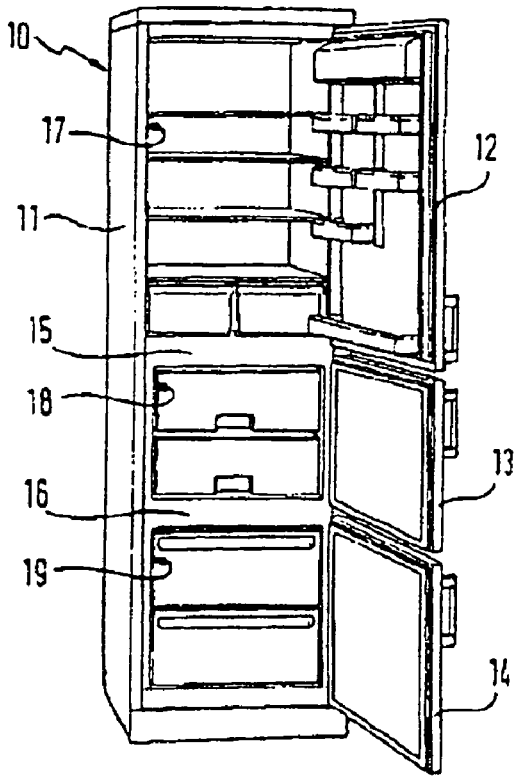
FIG. 1 is a perspective view of a household refrigerator with three temperature zones having a refrigerating machine according to the invention.

Referring now to the figures of the drawings in detail and first, particularly to FIG. 1 thereof, there is shown a household refrigerator 10 having a heat-insulating housing 11 and three doors 12, 13, 14 fastened thereto and pivotable about vertical axes of rotation. The doors 12, 13, 14 serve for the closing of compartments 17, 18, 19 that are disposed one above the other, are produced by two spaced-apart intermediate walls 15 and 16, are separated thermally from one another by these and have different storage temperatures. From the compartments 17, 18, 19, the upper compartment 17 closable by the door 12 is configured as a normal cooling compartment. The middle compartment 18 is separated from the upper compartment 17 by the intermediate wall 15, is capable of being covered by the door 13, and is configured as a cold storage compartment. The lower compartment 19, separated thermally from the cold storage compartment 18 by the intermediate wall 16, serves as a freezing compartment and can be closed by the door 14. The compartment-specific storage temperature prevailing in the individual compartments 17, 18, 19 is generated and maintained by a single refrigerant circuit.

Figure 2:
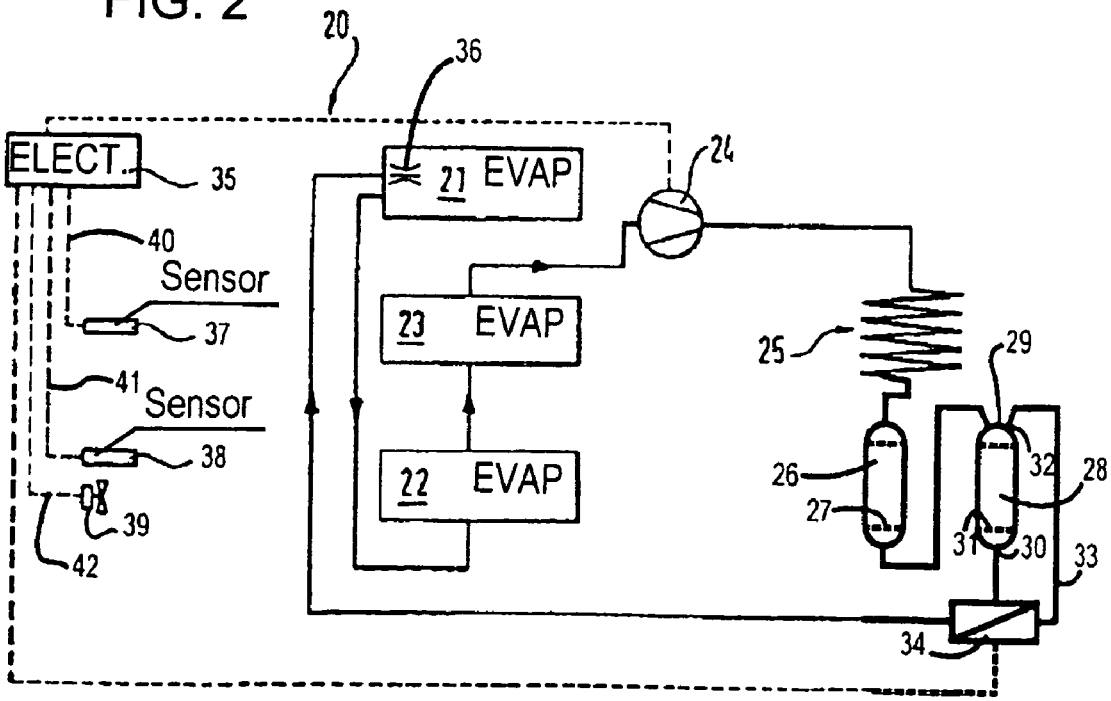
FIG. 2 is a block and schematic circuit diagram of a refrigerant circuit according to the invention and of the electronics provided for regulating the circuit.

As is evident from FIG. 2, to maintain the temperature of the individual compartments 17, 18, 19, the refrigerant circuit 20 is equipped with three evaporators 21, 22, 23 that are disposed one behind the other in a series connection within the refrigerant circuit and are equipped with a different refrigerating capacity and of which the evaporator 21 having the highest refrigerating capacity is associated with the freezing compartment 19 and has an injection point for the refrigerant. The freezing compartment evaporator 21 is followed on the outlet side, in the refrigerant flow direction, by the evaporator 22 that serves for cooling the cold storage compartment 18 and that is followed by the evaporator 23 associated with the normal cooling compartment 17 and having the lowest refrigerating capacity. The evaporator 23 is connected on the outlet side to the suction side of a refrigerant compressor 24 that is followed on the pressure side, in the refrigerant flow direction, by a condenser 25 that is disposed, for example, on the rear side of the housing 11 that faces away from the doors 12, 13, 14.

The condenser 25 is followed on the outlet side by a drier cartridge 26, in which hygroscopic material is prevented from escaping by a fine sieve 27.

The inlet of a refrigerant header 28 is connected to the outlet of the drier cartridge 26 through a pipeline. In the configuration described here, the refrigerant header 28 has a substantially cylindrical shape with a vertical longitudinal axis, similar to the drier cartridge 26. The inlet for the refrigerant is located at an upper end 29 of the refrigerant header. The refrigerant header 28 has two outlets, a first outlet 30 that is located in the region of its lower end and that refrigerant fed into the header can reach only after passing through a collecting sieve 31 mounted in the refrigerant header, and a second outlet 32 that is located at the upper end 29 of the header 28 in the immediate vicinity of the inlet of the header 28 and from which a secondary line 33 extends to a first inlet of a solenoid valve 34. A second inlet of the solenoid valve 34 is connected to the first outlet 30 of the refrigerant header 28.

The solenoid valve 34 can be changed over by evaluation and regulation electronics 35 between two states in which it connects either the first outlet 30 or the second outlet 32 of the refrigerant header 28 to the freezing compartment evaporator 21 through a throttle 36.

In a first switching state of the solenoid valve 34, in which the first outlet 30 of the refrigerant header 28 is connected to the freezing compartment evaporator 21, a mixture of gaseous and liquid refrigerant, the mixture originating from the condenser 25, flows through the entire inner volume of the refrigerant header 28. The ratio of liquid to gaseous refrigerant in the header 25 in this case corresponds virtually to that at the outlet of the condenser 25. Under these conditions, the throughput of liquid refrigerant through the header 28 is such that still liquid refrigerant arrives at the evaporator 23 of the cooling compartment 18, evaporates in the evaporator 23, and, thus, cools the cooling compartment 18.

Particle-like impurities possibly entrained in the refrigerant stream are, in this case, intercepted either at the fine sieve 27 of the drier cartridge 26 or at the collecting sieve 31 of the refrigerant header 28. Because the flow passes through the fine sieve 27 first, preferably, a larger mesh width is selected for the fine sieve 27 than for the collecting sieve 31 so that the impurities, separated into two fractions according to particle size, are, in each case, intercepted at one of the two sieves, without one of these being clogged to an extent such that this has an appreciable effect on the flow resistance of the refrigerant circuit.

In a second switching position of the solenoid valve 34, the refrigerant flows through the refrigerant header 28 from its inlet to the second outlet 32. The refrigerant can reach the second outlet 32, without having to pass across the collecting sieve 31 for this purpose; solid impurities possibly entrained in the refrigerant stream sink in the refrigerant header 28 solely by virtue of their density in the refrigerant header 28, which is high in comparison with the refrigerant, and settle on the collecting sieve 31. That is to say, even in this state of the solenoid valve 34, such impurities are filtered out, without the flow, nevertheless, having to pass through the collecting sieve 31 for this purpose.

In the second switching position of the solenoid valve 34, liquid refrigerant that collects on the bottom of the refrigerant header 28 is not sucked away; instead, it accumulates in the refrigerant header 28, with the result that the quantity of refrigerant constantly circulating the refrigerant circuit is reduced. The volume of the refrigerant header 28 is fixed such that when the latter has reached a stationary filling state in the second position of the solenoid valve 34, the refrigerant quantity circulating the refrigerant circuit is still just sufficient to supply the freezing compartment evaporator 21 and the evaporator 22 of the cold storage compartment with liquid refrigerant, but no longer the evaporator 23 of the normal cooling compartment that, therefore, remains uncooled in the second position of the solenoid valve 34.

Control signals that fix the position of the solenoid valve 34 are generated by the evaluation and regulation electronics 35, not described in detail, which are connected to temperature sensors 37, 38 and to a fan 39. The temperature sensors 37, 38 are, for example, NTC sensors that are disposed for detecting the air temperature in the normal cooling compartment 17 and the cold storage compartment 18, respectively, and that deliver voltage signals representing the detected temperatures to the electronics 36 through lines 40, 41.

The fan 39 disposed in the cold storage compartment 18 can be switched on and off or its speed regulated by the electronics 35 through a further line 42, in order, as required, to intensify by a more or less intensive air flow in the cold storage compartment the heat exchange between the latter and the evaporator assigned thereto and, thus, to cool the cold storage compartment 18 to an increased extent. This results in the following possibilities for operating the refrigerant circuit as a function of the temperatures detected by the sensors 17, 18:

a) operation of the compressor 24 in the first position of the solenoid valve 34, cooling of all three evaporators 21, 22, 23;

b) operation of the compressor 24 in the first position of the solenoid valve 34, with the fan 39 switched on: cooling of all three compartments 17, 18, 19, preference being given to the cold storage compartment 18;

c) operation in the second position of the solenoid valve 34, with the fan 39 switched off: cooling of the freezing compartment 19 and cold storage compartment 18; and d) operation in the second position of the solenoid valve 34, with the fan 39 switched on: cooling of the freezing compartment 19 and cold storage compartment 18, preference being given to the cold storage compartment 18.

These four operating modes make it possible to regulate the temperatures in the three compartments 17 to 19 largely independently of one another.

Of course, as a modification of the example outlined above, the various evaporators 21, 22, 23 may also be connected in parallel, instead of in series, and be capable of being supplied selectively with refrigerant by different switching positions of the solenoid valve. It is also possible to use a one-piece evaporator board, various regions of which in each case assume the tasks of the evaporators 21, 22, 23. In such a case, a subdivision of this evaporator board into portions corresponding to the evaporators 21, 22, 23 by physical divisions is not necessary; the limit between a region corresponding to the cold storage compartment evaporator 22 and a region corresponding to the normal cooling compartment evaporator 23 may arise simply from the capacity of the refrigerant header 28 and, consequently, from the position of the point on the unitary evaporator board at which the refrigerant is evaporated completely in the second position of the solenoid valve.

I claim:

1. A refrigerator, comprising a housing defining at least one cooling compartment;

a compressor for compressing a refrigerant;

a condenser;

a refrigerant header; and an evaporator, the compressor, the condenser, the refrigerant header, and the evaporator together defining a circulation header path along which a refrigerant is circulated with the compressor being upstream of the condenser, the condenser being upstream of the refrigerant header, and the refrigerant header being upstream of the evaporator, and the refrigerant header having:

an inlet, a first outlet, and a collecting sieve forming a first header path, the collecting sieve being disposed between the inlet and the first outlet of the refrigerant header for intercepting from a stream of a refrigerant being circulated in the refrigerator any impurities that exceed an intercept size;

a secondary line, the secondary line and the inlet forming a second header path, a header exit communicated with the evaporator, and a directional valve communicated with the first outlet and the secondary line, the directional valve being operable in one state and in another state, the directional valve, in its one state, receiving from the first outlet a refrigerant stream that has traveled along the first header path, and, in its another state, receiving from the secondary outlet a refrigerant stream that has traveled along the second header path, and the directional valve being communicated with the header exit, in the one state of the directional valve, for the passage of a refrigerant stream received by the directional valve from the first header path from the directional valve to the header exit, and being communicated with the header exit, in the another state of the directional valve, for the passage of a refrigerant stream received by the directional valve from the second header path from the directional valve to the header exit, the refrigerant header being operable to handle a refrigerant stream having certain impurities of a predetermined size such that, when the directional valve guides a refrigerant stream having such certain impurities of a predetermined size along the second header path, a separation of such certain impurities of a predetermined size in the refrigerant stream from other portions of the refrigerant stream is effected during passage of the refrigerant stream from the inlet to the secondary line and only these other portions of the refrigerant stream enter the secondary line while the certain impurities of a predetermined size are disentrained from the refrigerant stream and do not enter the secondary line, and the refrigerant header being operable in the one state of the directional valve to guide a refrigerant stream having such certain impurities of a predetermined size through the first header path such that the refrigerant stream with such certain impurities of a predetermined size successively flows through the inlet, thereafter through the collecting sieve whereat impurities exceeding the intercept size that may be present in the refrigerant stream are intercepted, thereafter through the first outlet, and thereafter through the directional valve to the header exit without such refrigerant stream passing through the secondary line and the refrigerator being operable, in the another state of the directional valve, to guide a refrigerant stream with such certain impurities of a predetermined size through the second header path such that the refrigerant stream successively flows through the inlet, thereafter through the secondary line, and thereafter through the directional valve to the header exit without such refrigerant stream passing through either one of the collecting sieve and the first outlet.

2. The refrigerating machine according to claim 1 and further comprising a drier fluidically connected to the inlet of the refrigerant header and to the condenser, the drier having a fine sieve for intercepting impurities of the refrigerant stream, and the collecting sieve of the refrigerator header has a mesh size finer than the fine sieve of the drier.

3. The refrigerating machine according to claim 1, wherein the separation of such certain impurities of a predetermined size in a refrigerant stream from other portions of the refrigerant stream in the refrigerant header is effected by a disposition of the inlet and the secondary line of the refrigerator header relative to one another such that a sinking of such certain impurities of a predetermined size out of the refrigerant stream during passage of the refrigerant stream from the inlet to the secondary line occurs as a function of a density property of such certain impurities of a predetermined size in the refrigerant stream being different than the a density property of the other portions of the refrigerant stream.

* * * * *